US006336644B1

(12) United States Patent
Chu

(10) Patent No.: US 6,336,644 B1
(45) Date of Patent: Jan. 8, 2002

(54) COMBINED SPORTS SHOE AND ROLLER SKATE

(75) Inventor: Yi-Tien Chu, Taipei (TW)

(73) Assignee: Ching-Long Chen, Taipei (TW)

( * ) Notice: Subject to any disclaimer, the term of this patent is extended or adjusted under 35 U.S.C. 154(b) by 0 days.

(21) Appl. No.: 09/630,799

(22) Filed: Aug. 2, 2000

(51) Int. Cl.[7] ..... A63C 17/04

(52) U.S. Cl. ..... 280/11.233; 280/11.221; 280/11.26; 280/11.27; 280/11.33; 36/115

(58) Field of Search ..... 280/11.19, 11.27, 280/11.26, 11.3, 11.32, 11.33, 11.34, 841, 11.233, 11.221; 36/115, 15

(56) References Cited

U.S. PATENT DOCUMENTS 3,884,485 A * 5/1975 Walle ..... 280/841
3,979,842 A * 9/1976 Texidor ..... 36/115
3,983,643 A * 10/1976 Schreyer et al. ..... 36/115
4,333,249 A * 6/1982 Schaefer ..... 36/115
5,398,970 A * 3/1995 Tucky ..... 280/841
5,511,824 A * 4/1996 Kim ..... 280/841
5,785,327 A * 7/1998 Gallant ..... 280/11.27
5,797,609 A * 8/1998 Fichepain ..... 280/11.19
6,120,039 A * 9/2000 Clementi ..... 280/11.19

* cited by examiner

*Primary Examiner*—Daniel G. DePumpo
*Assistant Examiner*—James S. McClellan
(74) *Attorney, Agent, or Firm*—Rosenberg, Klein & Lee

(57) ABSTRACT

A combined sports shoe and roller skate includes a sole having a chamber in which is mounted a collapsible roller assembly, wherein the roller assembly has a seat pivotally connected with linking rods, positioning rods, rear arms, front arms, rollers and torsion spring at two sides and a control mechanism is mounted on the seat and composed of a locking bolt, an axle, a pawl, a torsion spring, a tension spring and a pushbutton, whereby the sports shoe can be converted into a roller skate as desired simply by depressing a pushbutton and the roller skate can be also converted into a sports shoe by collapsing the roller assembly into a chamber at the bottom of the sole.

5 Claims, 13 Drawing Sheets

COMBINED SPORTS SHOE AND ROLLER SKATE

BACKGROUND OF THE INVENTION

1. Field of the Invention

This invention is related to a combined sports shoe and roller skate and in particular to one provided at the bottom with a collapsible roller assembly which can be controlled to convert a sports shoe into a roller skate as desired.

2. Description of the Prior Art

Referring to FIG. 1, the conventional combined sports shoe and roller skate comprises a body 10 having a bottom formed with a chamber 14. A bottom plate 11 which has a plurality of holes 12 is arranged inside the body 10. A roller seat 20 is fitted inside the chamber 14 of the body 10 and fixedly mounted on the bottom of the bottom plate 11 by screws 13. The roller seat 20 includes a base 21 and a moveable bracket 22. The base 21 has two lugs each having a hole 211 through which a pin 23 is passed for pivotally coupling the bracket 22. The bracket 22 includes a rod 221 for fixing an end of a spring 26. The other end of the spring 26 is fixedly connected with the base 21. A roller 25 is pivotally connected with the moveable bracket 22 by a bolt 24, and the roller 25 can be turned out of the chamber 14 to convert the shoe into a roller skate, or turned into the chamber 14 to convert the roller skate into a sports shoe as desired. However, the user must use his or her fingers to turn roller 25 into or out of the chamber 14 of the bottom of the shoe thereby causing much inconvenience in use and making the fingers very dirty.

Therefore, it is an object of the present invention to provide a combined sports shoe and roller skate which can obviate and mitigate the above-mentioned drawbacks.

SUMMARY OF THE INVENTION

This invention is related to an improvement in the structure of a combined sports shoe and roller skate.

It is the primary object of the present invention to provide a combined sports shoe and roller skate which utilizes a control button to control a roller assembly to turn out or into a chamber at the bottom of the shoe so as to convert the sports shoe into a roller skate or convert the roller skate into a sports shoe as desired.

It is another object of the present invention to provide a combined sports shoe and roller skate which utilizes a linking rod to control front arms and rear arms to open or collapse the rollers.

According to a preferred embodiment of the present invention, a combined sports shoe and roller skate includes a sole having a chamber in which is mounted a collapsible roller assembly, wherein the roller assembly has a seat pivotally connected with linking rods, positioning rods, rear arms, front arms, rollers and torsion spring at two sides and a control mechanism is mounted on the seat and composed of a locking bolt, an axle, a pawl, a torsion spring, a tension spring and a pushbutton, whereby the sports shoe can be converted into a roller skate as desired simply by depressing a pushbutton and the roller skate can be also converted into a sports shoe by collapsing the roller assembly into a chamber at the bottom of the sole.

Other objects and merits and advantages of the present invention will become apparent when the following detailed description is read in conjunction with the accompanying drawings.

DETAILED DESCRIPTION OF THE PREFERRED EMBODIMENT

Figure 1:
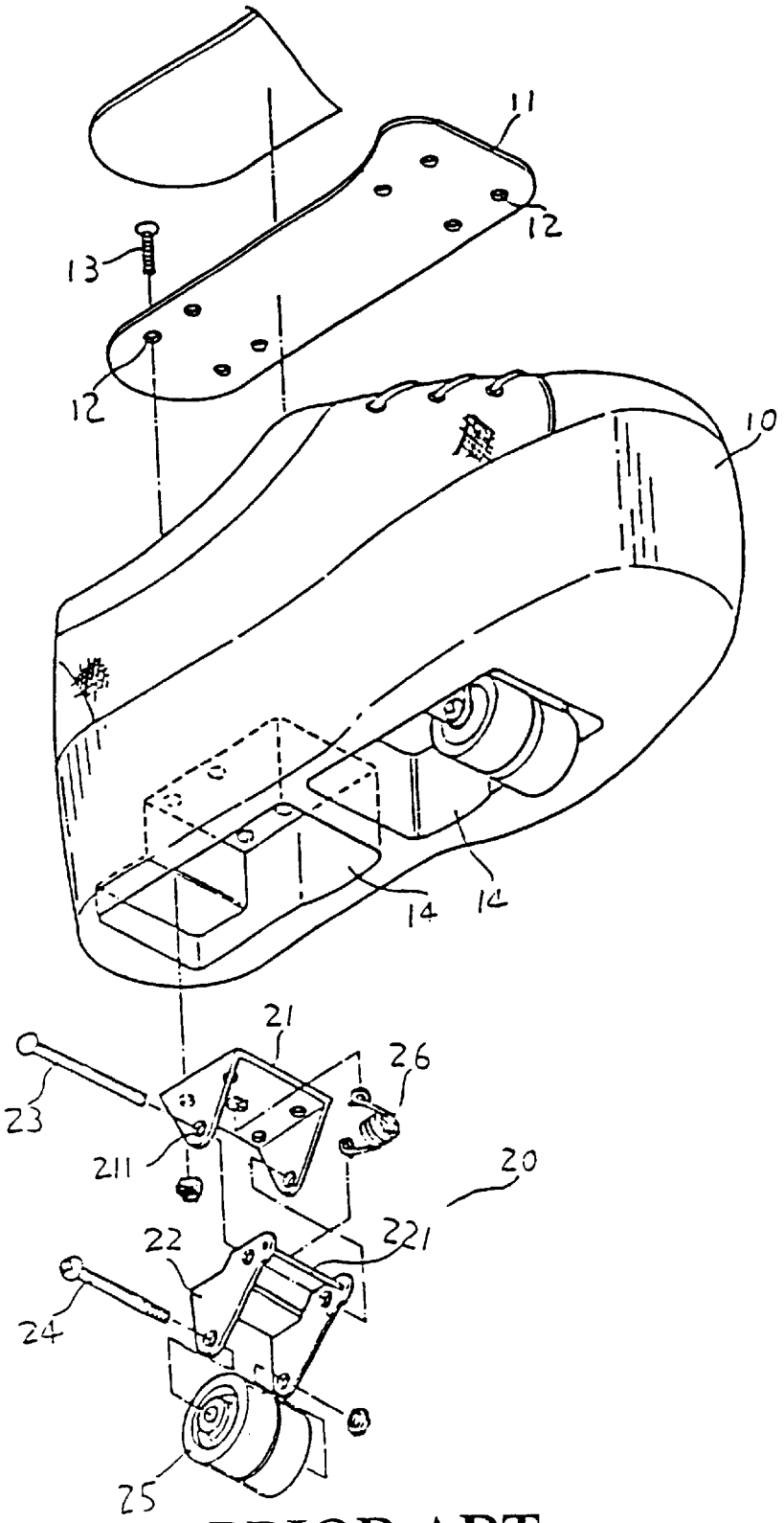
PRIOR ART FIG.1
FIG. 1 is an exploded view of a prior art combined sports shoe and roller skate.
Figure 2:
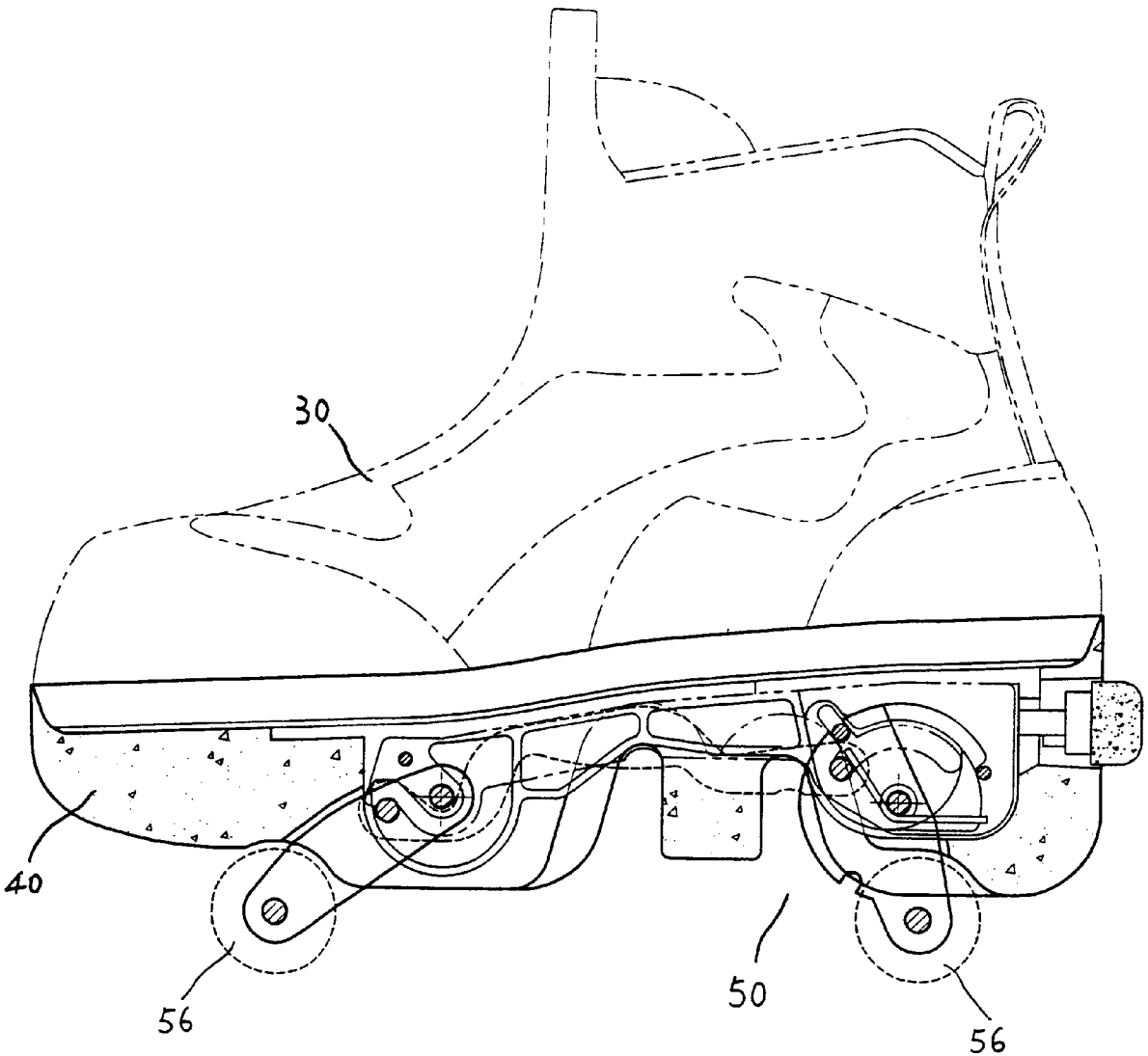
FIG. 2 is a side view of the present invention.
Figure 3:
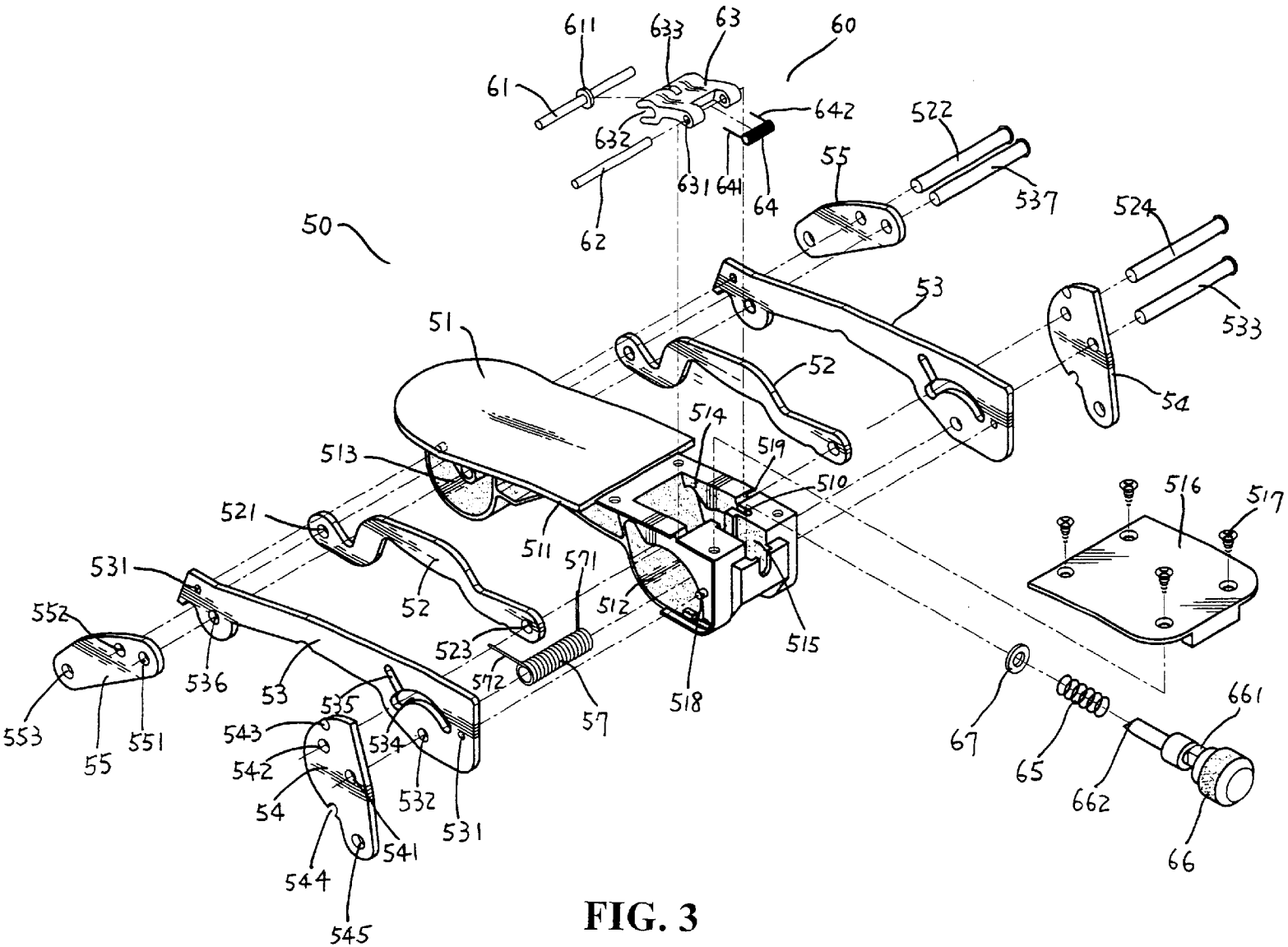
FIG. 3 is an exploded view of the roller assembly according to the present invention.
Figure 4:
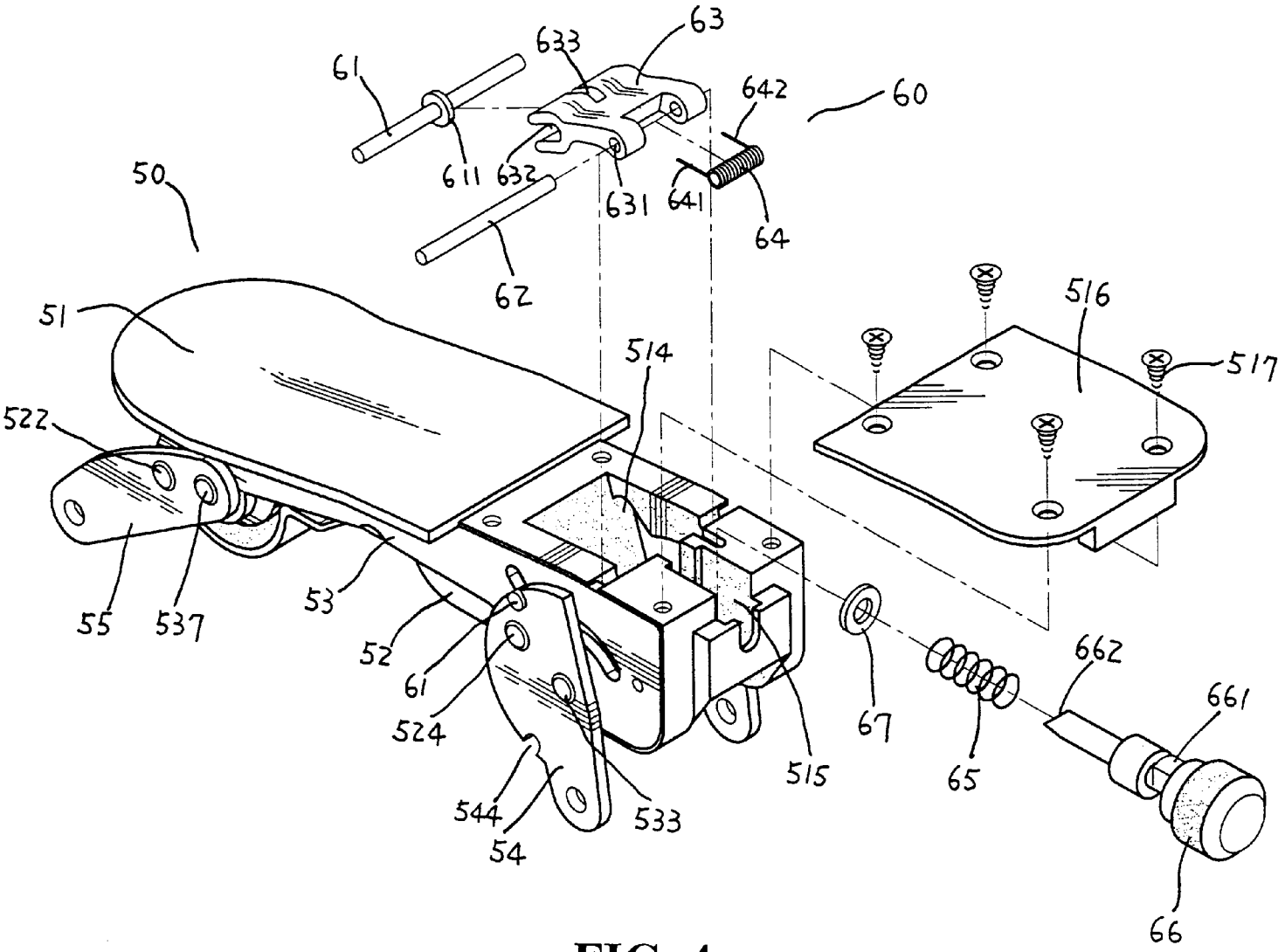
FIG. 4 is an exploded view of the control mechanism according to the present invention.
Figure 5:
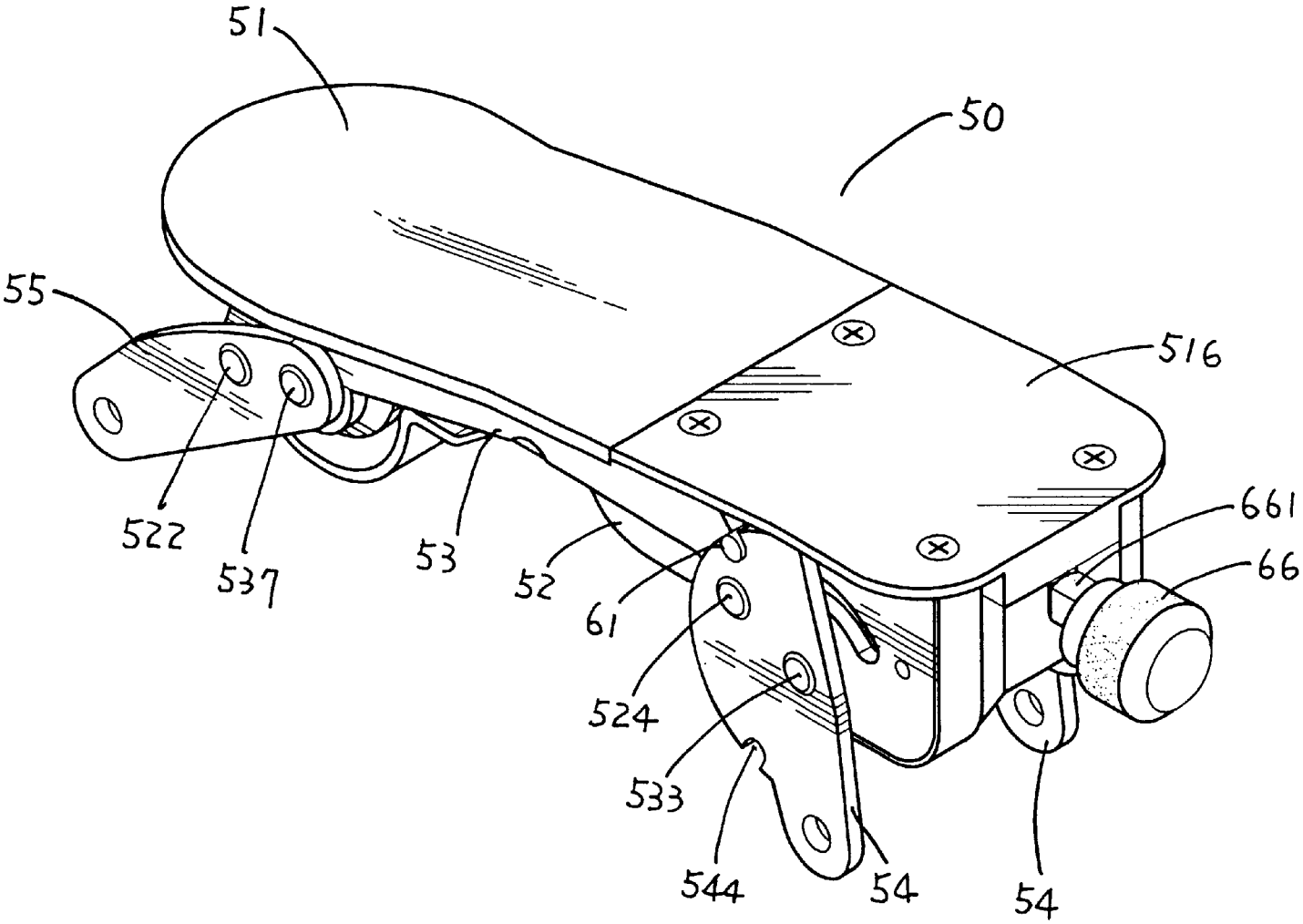
FIG. 5 is a perspective view of the roller assembly according to the present invention.
Figure 6:
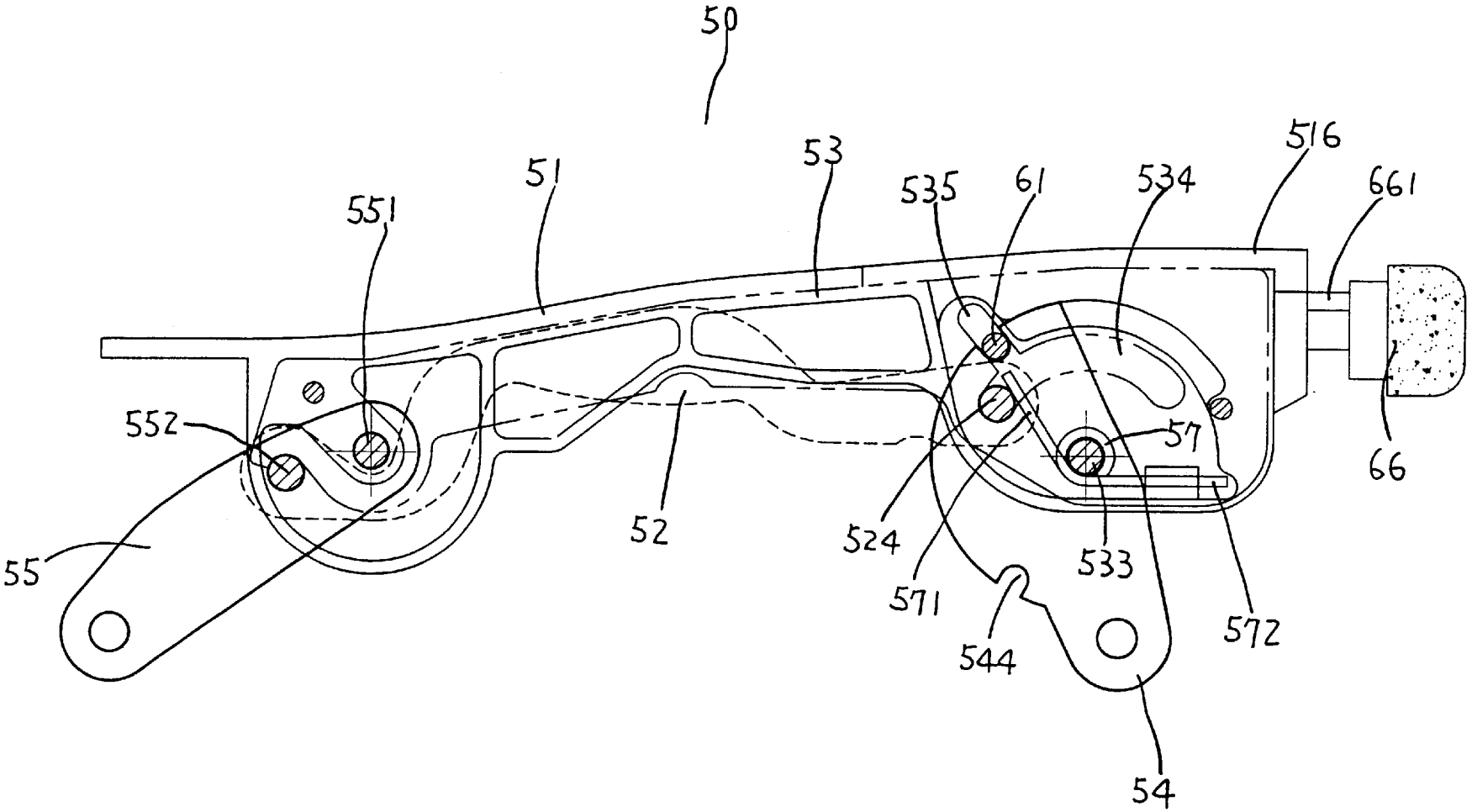
FIG. 6 is a side view of the roller assembly according to the present invention.
Figure 7:
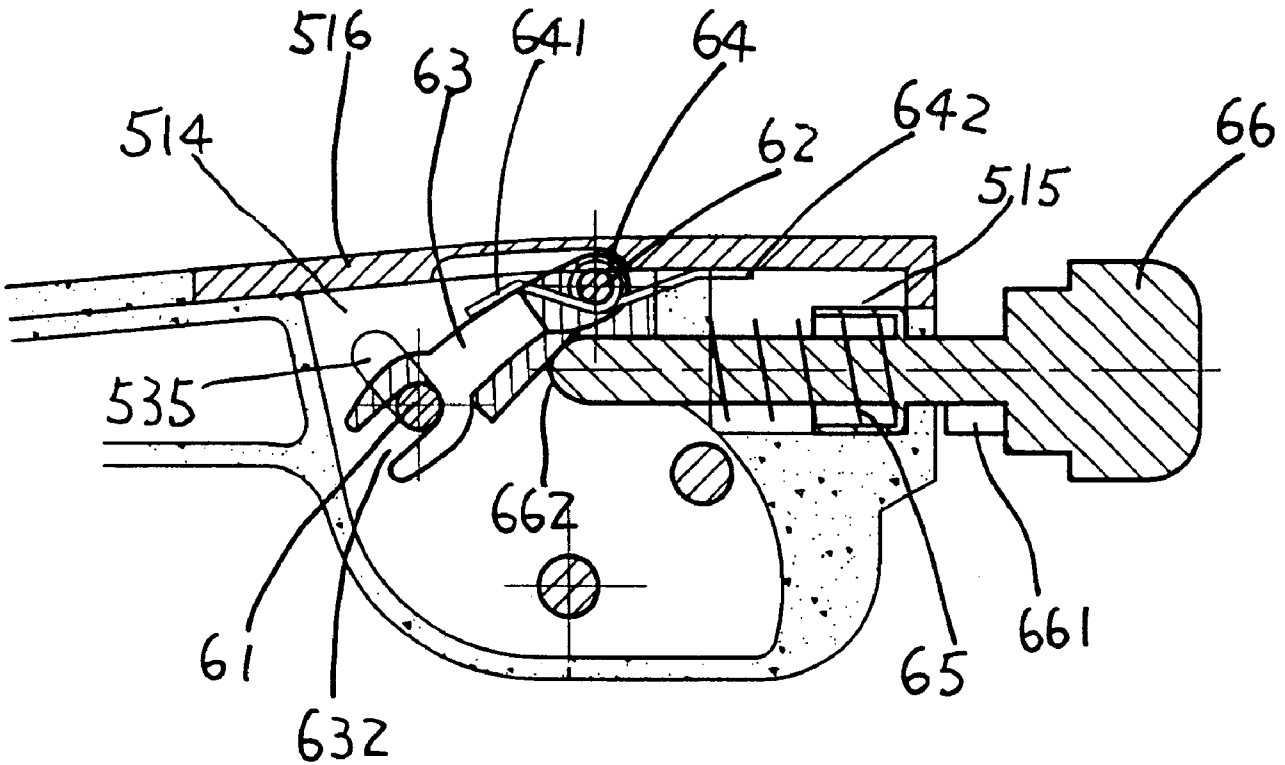
FIG. 7 is a sectional view of the control mechanism according to the present invention.
Figure 8:
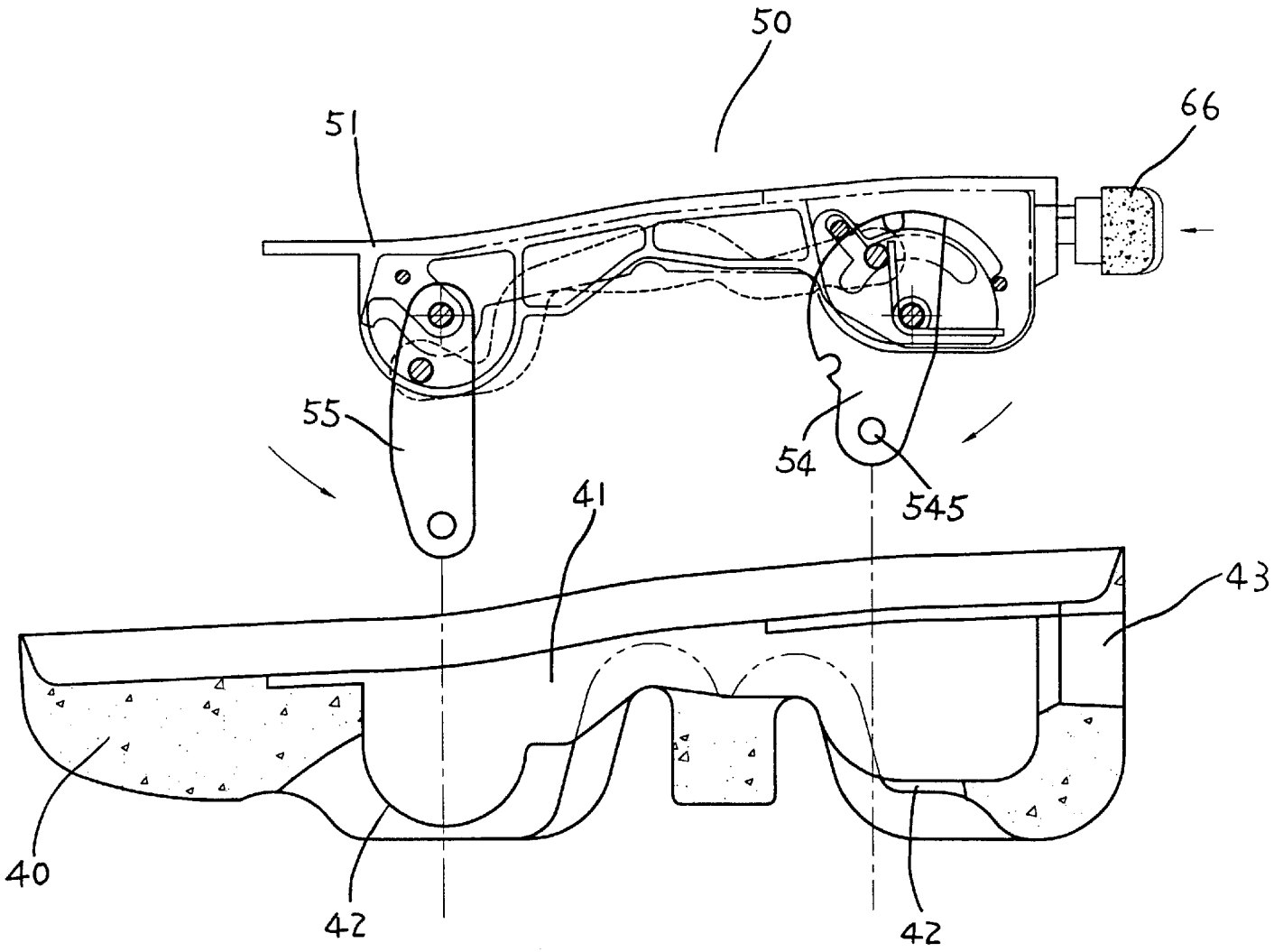
FIG. 8 illustrates the relationship between the roller assembly and the sole according to the present invention.
Figure 9:
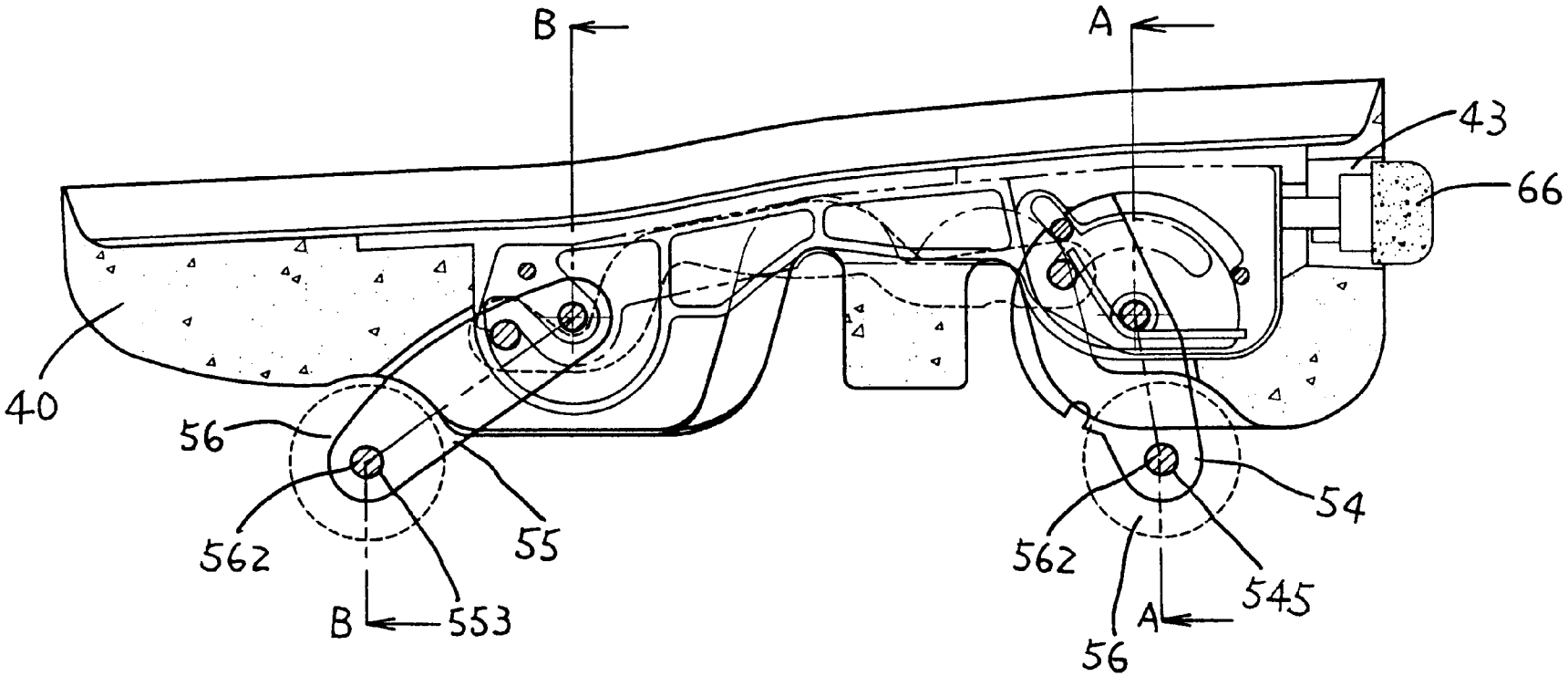
FIG. 9 is a sectional view illustrating the relationship between the roller assembly and the sole according to the present invention.
Figure 10:
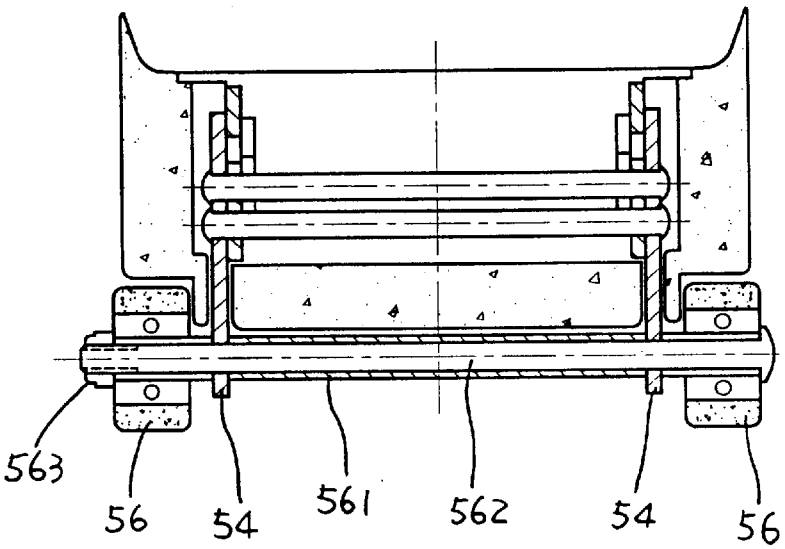
FIG. 10 is a sectional view taken along line A—A of FIG. 9.
Figure 11:
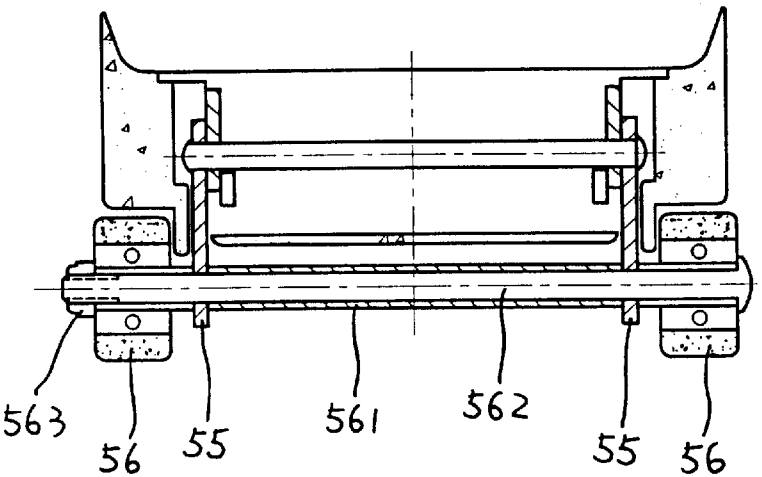
FIG. 11 is a sectional view taken along line B—B of FIG. 9.

With reference to the drawings and in particular to FIGS. 2 through 7, the combined sports shoe and roller skate according to the present invention generally comprises a body portion 30 and a sole 40. The sole 40 is provided with a collapsible roller assembly 50 for converting the sports shoe into a roller skate or converting the roller skate into a sports shoe as desired.

The roller assembly 50 includes a seat 51 having a pair of guide pins 522 and 524 and a pair of axle pins 533 and 537 on which are pivotally mounted a pair of linking rods 52, a pair of positioning arms 53, a pair of rear arms 54, a pair of front arms 55, two pair of rollers 56, and a torsion spring 57. The seat 51 has a top 511 a rear open space 512 and a front open space 513. The rear open space 512 is formed with a rectangular chamber 514 and an end chamber 515 in communication with the rectangular chamber 514. A control mechanism 60 is mounted within the rectangular chamber 514 and the end chamber 515 and a covering plate 516 is installed on the top of the rear open space 512 by bolts 517.

The linking rod 52 is positioned between one side of the seat 51 and the positioning arm 53 and has a hole 521 at the front end. The linking rods 52 are pivotally mounted with the front arms 55 by a guide pin 522 extending through the front open space 513 and the intermediate holes 552 of the front arms 55. Further, the linking rods 52 are pivotally connected to the rear arms 54 by a guide pin 524 extending through the rear open space 512 of the seat 51 and upper holes 542 of the rear arms 54.

The positioning arm 53 is formed with two holes 531 at two ends thereof engaged with respective protuberances 518 of the seat 51. The rear portion of the position arm 53 has a hole 532 through which the axle pin 533 extends through the rear open space 512 of the seat 51, the torsion spring 57 and the intermediate hole 541 of the rear arm 54. The rear portion of the position arm 53 further has a curved groove 534 for receiving the guide pin 524 extending through a rear hole 523 of the linking rod 52. The curved groove 534 has a radial hole 535 extending therefrom. The positioning arms 53 are pivotally connected with the front arms 55 by an axle pin 537 extending through the front open space 513 of the seat 51 and upper holes 551 of the front arms 55.

The front arm 55 has an upper hole 551, an intermediate hole 552, and a lower hole 553, wherein the upper hole 551 receives the axle pin 537 extending through a hole 536 of the positioning arm 53 while the intermediate hole 552 receives the guide pin 522 extending through the front hole 521 of he linking rod 52.

The torsion spring 57 is sleeved on the axle pin 533 and includes a coiled body at the intermediate portion and two legs 571 and 572 at two ends thereof One leg 571 of the torsion spring 57 bears against the guide pin 524 extending through the rear hole 523 of the linking rod 52, the curved groove 534 of the positioning arm 53 and the upper notch 543 of the rear arm 54, while the other leg 572 of the torsion spring 57 presses the inner bottom side of the rear open space 512 of the seat 51.

The control mechanism 60 comprises a locking bolt 61, an axle 62, a pawl 63, a torsion spring 64, a tension spring 65 an a pushbutton 66.

The bolt 61 extends through the radial slot 535 of the positioning arm 53 and engages with the upper notches 543 of the rear arms 54. The intermediate portion of the bolt 61 is formed with an enlarged circular member 611. The axle 62 extends through the pawl 63 and the torsion spring 64 and fitted into the recesses 519 on the top of the seat 51.

The pawl 63 has a pair of lugs each having a hole 631 for the passage of the axle 62 which extends through the holes 631 and the torsion spring 64 to keep the torsion spring between the two lugs of the pawl 63. The torsion spring 64 has one leg 641 pressing against the top of the pawl 63 and another leg 642 fitted into a recess 510 of the seat 51 (see FIG. 7).

The pushbutton 66 has a stop portion 661 at the intermediate portion thereof and a shaft on which are mounted a spring 65 and a packing ring 67. The pushbutton 66 is arranged inside the end chamber 515 of the seat 51, with its tip 662 pushing against the bottom of the pawl 63 (see FIG. 7).

The installation between the roller assembly 50 and the sole 40 will now be described as follows:

Referring to FIGS. 8 through 12, the sole 40 is formed at the top with a cavity 41 configured and sized to receive the roller assembly 50. The cavity 41 has two openings 42 at the bottom and a hole 43 at the rear end of the front arms 55 are pivotally connected with the rollers 56 by a sleeve 561, a bolt 562 and a nut 563.

The roller assembly 50 is fixedly mounted into the sole 40 by resin or the like, and the fixation may be accomplished by any other means well known to those skilled in the art and is not considered a part of the invention.

Figure 12:
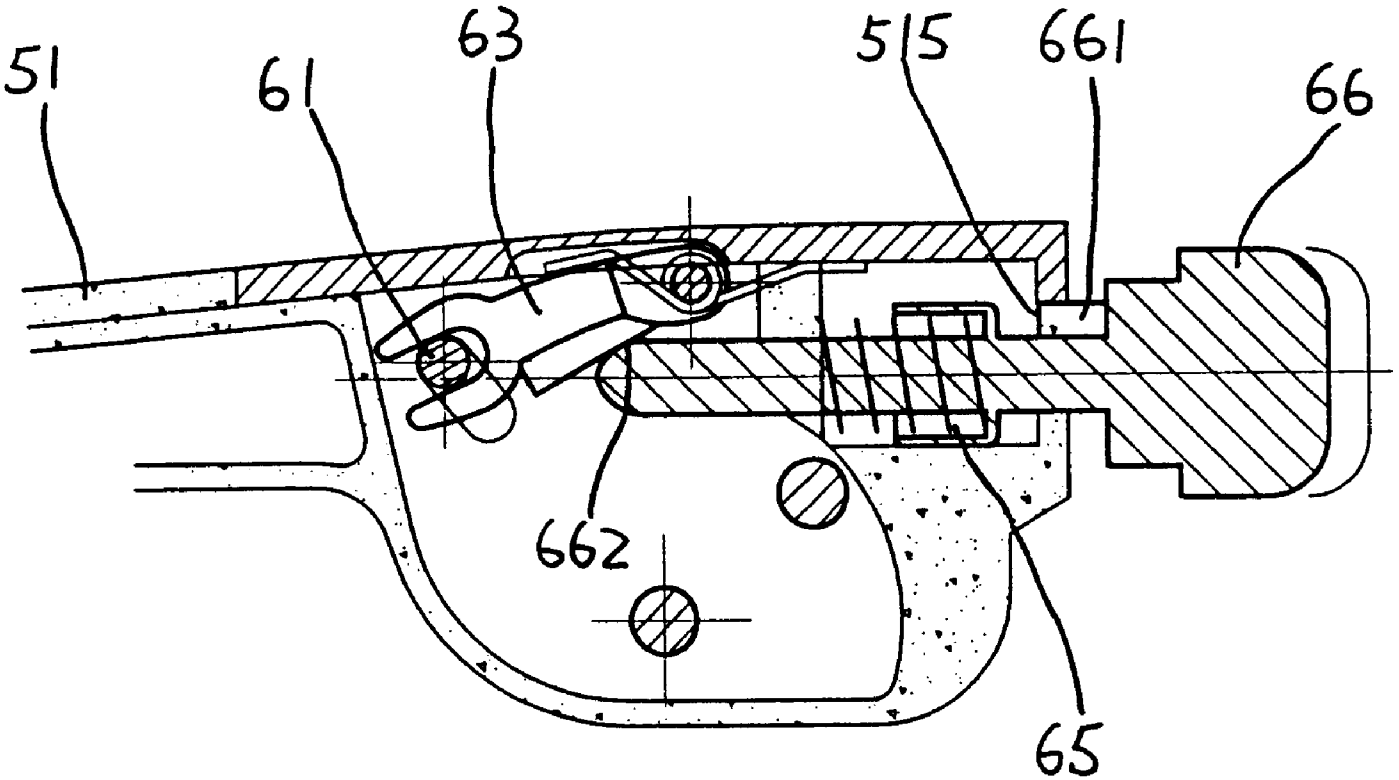
FIG. 12 illustrates how the pushbutton is depressed into the shoe.
Figure 13:
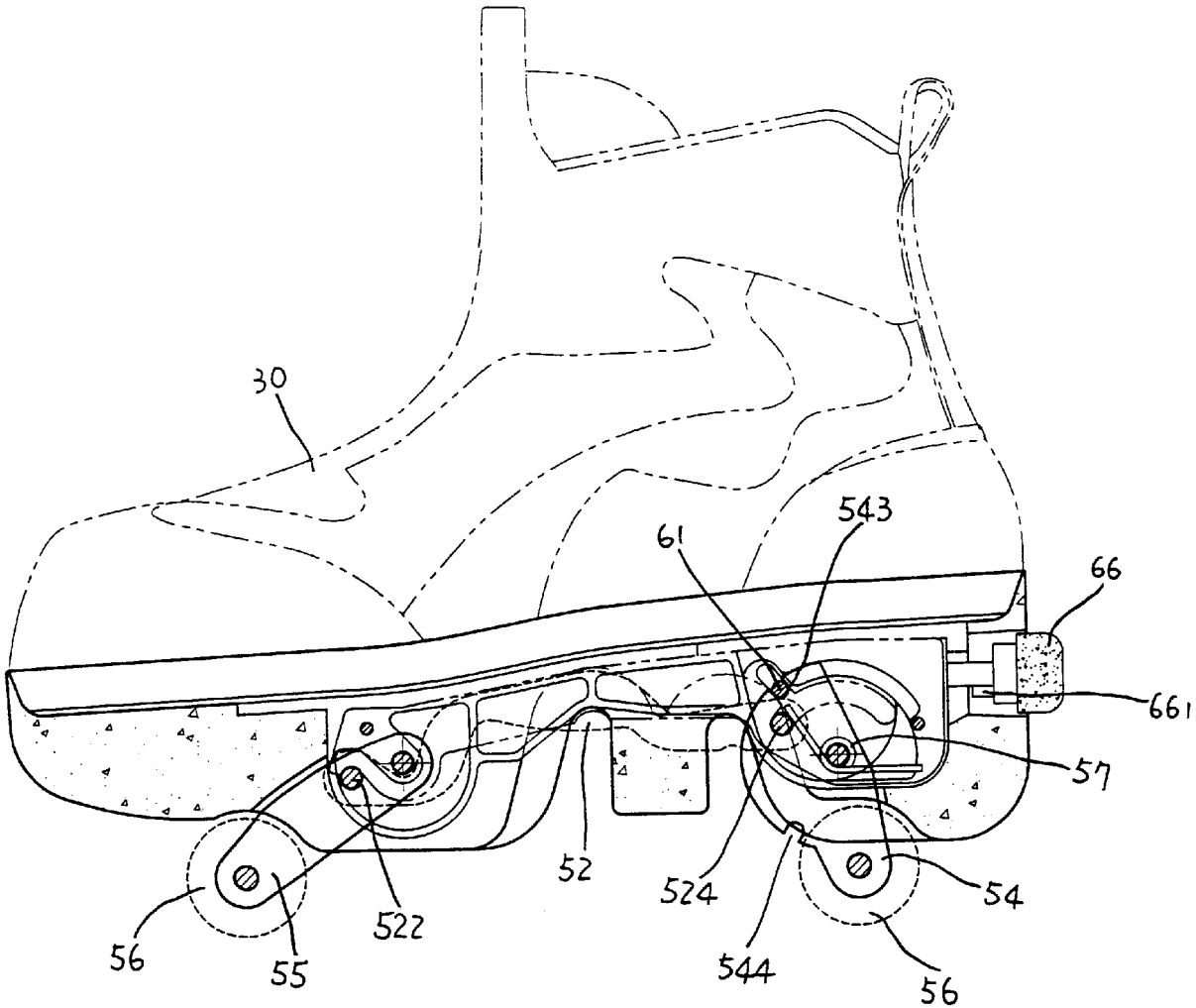
FIG. 13 illustrates how the sports shoe is converted into a roller skate.

The working principle of the present invention will now be described in detail as follows:

Referring to FIGS. 12 and 13, the pushbutton 66 is first depressed to cause its tip 662 to push the pawl 63 to move upwardly, so that the pawl 63 will move the locking bolt 61 out of the notches 544 to the rear arms 54. Meanwhile, the torsion spring 57 will push the guide pin 524 to rotate the rear arms 54 and move the linking rod 52 which will in turn move the guide pin 522 to rotate the front arms 55 until the locking bolt 61 is engaged with the upper notches of the rear arms 54, thereby driving the rollers 56 out the sole 40 to convert the shoe into a roller skate. Finally, the pushbutton 66 is turned so that the stop portion 661 of the pushbutton 66 is located at the lower position to lock the roller assembly 50 in place.

Figure 14:
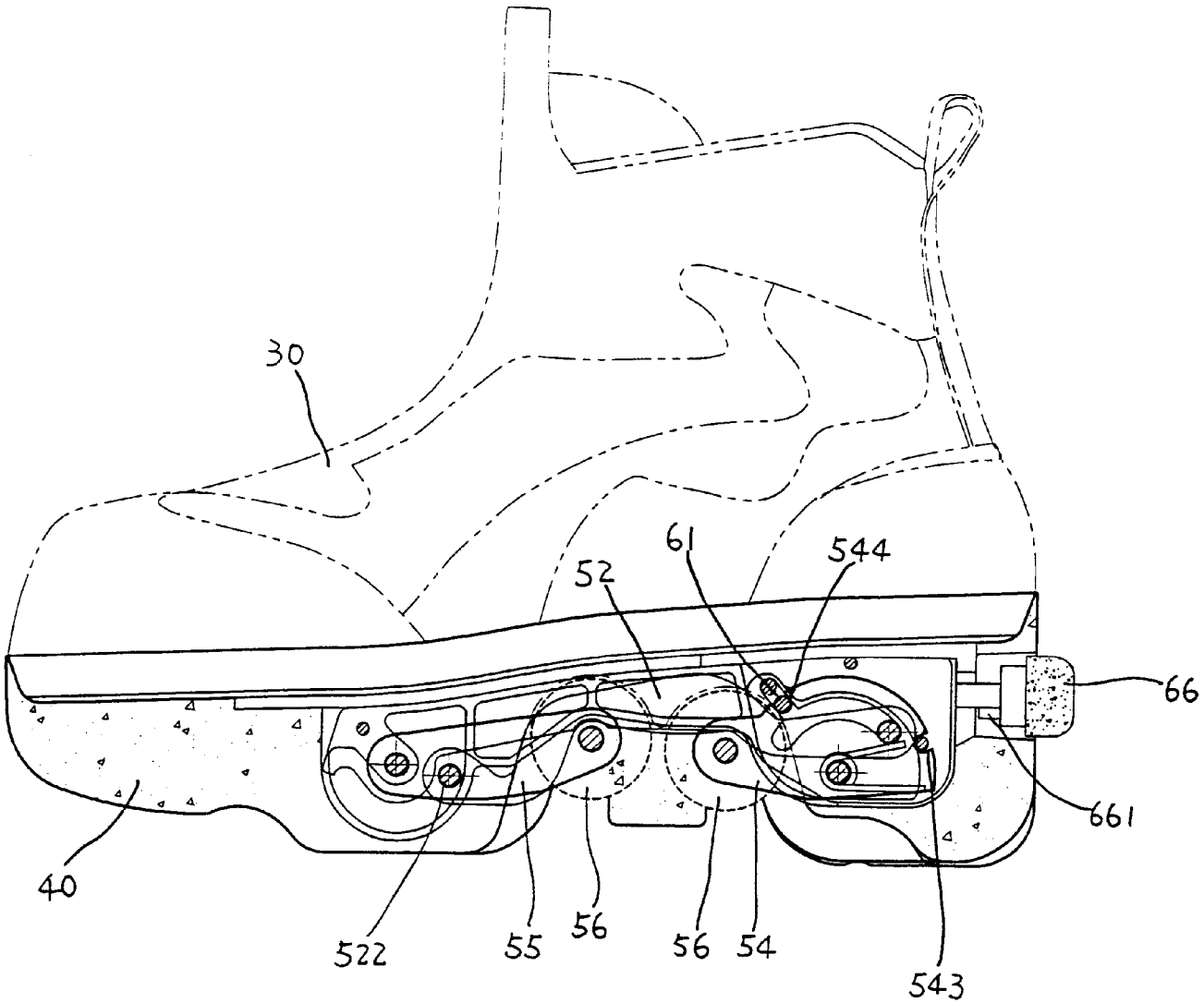
FIG. 14 illustrates how the roller skate is converted into a sports shoe.

When desired to collapse the rollers 56 (see FIGS. 12 through 14), the pushbutton 66 is first turned so that the stop portion 661 of the pushbutton 66 is rotated to the upper position to align with the chamber 515 of the seat 51 and then the pushbutton 66 is depressed to make the tip 662 push against the pawl 63 to move upwardly thereby pushing the locking bolt 61 upwardly out of the notches 543 of the rear arms 54, so that the front and rear arms 55 and 54 can be turned to collapse the rollers 56 until the locking bolt 61 is engaged with the lower notches 544 of the rear arms 54 thereby converting the roller skate into a sports shoe. Finally, the pushbutton 66 is turned so that the stop portion 661 is located at the lower position thereby locking the roller assembly 50 within the sole 40.

Although the present invention bas been described with a certain degree of particularity, it is understood that numerous changes can be made to the present invention within a reasonable scope of the invention.

I claim:

1. A combination shoe and roller skate comprising:

(a) a sole having a cavity formed therein;

(b) a roller assembly disposed within said sole cavity, said roller assembly including:

(1) a longitudinally extended seat;

(2) a pair of positioning arms coupled to opposing sides of said seat, said positioning arms each having formed therein an arcuate groove and a radial hole extending transversely therefrom;

(3) a pair of primary arms each pivotally coupled to one said positioning arm at a first pivot axis, each said primary arm being pivotally displaceable about said first pivot axis between first and second positions relative to said positioning arm, each said primary arm having formed peripherally thereon at least first and second notches spaced one from the other, each said primary arm being coupled to a laterally extending primary guide pin, said primary guide pin displaceably engaging said arcuate groove of at least one said positioning arm;

(4) a pair of secondary arms each pivotally coupled to one said positioning arm at a second pivot axis, each said secondary arm being pivotally displaceable about said second pivot axis between first and second positions relative to said positioning arm, each said secondary arm being coupled to a laterally extending secondary guide pin; and, (5) at least one linking rod extending between said primary and secondary guide pins for linking the pivotal displacements of said primary and secondary arms; and, (c) a control mechanism coupled to said roller assembly for alternatively setting said roller assembly in stowed and extended configurations, said control mechanism including:

(1) a locking member pivotally coupled to said seat, said locking member being spring biased to lockingly engage said first notch of at least one said primary arm when said primary arm is in said first position and to lockingly engage said second notch when said primary arm is in said second position; and, (2) an actuation member displaceably coupled to said seat for actuating said locking member, said actuation member being displaceable between first and second control positions;

said locking member being alternatively engaged with and disengaged from said primary arm notches responsive to said control position selected for said actuation member.

2. The combination shoe and roller skate as recited in claim 1 comprising a pair of said linking rods respectively disposed adjacent said opposing sides of said seat.

3. The combination shoe and roller skate as recited in claim 1 wherein said locking member includes:

(a) a pawl pivotally coupled in spring biased manner to said seat; and, (b) a laterally extending buckling bolt coupled to said pawl, said buckling bolt slidably engaging said radial hole of at least one said positioning arm;

said pawl slidably displacing said buckling bolt in said radial hole responsive to said actuation member being displaced between said first and second control positions.

4. The combination shoe and roller skate as recited in claim 1 wherein said actuation member includes a pushbutton coupled to said seat in longitudinally displaceable manner, said pushbutton being spring biased to said first control position.

5. The combination shoe and roller skate as recited in claim 4 wherein said pushbutton is rotatable about a longitudinal axis between first and second angular positions, said pushbutton including a stop portion, said stop portion in said first angular position engaging said seat to limit the longitudinal displacement of said pushbutton, said stop portion in said second angular position being disengaged from said seat.

* * * * *